US010008069B2

(12) United States Patent
Elie et al.

(10) Patent No.: US 10,008,069 B2
(45) Date of Patent: Jun. 26, 2018

(54) MULTI-PASSENGER DOOR DETECTION FOR A PASSENGER TRANSPORT

(71) Applicant: Ford Global Technologies, LLC, Dearborn, MI (US)

(72) Inventors: Larry Dean Elie, Ypsilanti, MI (US); Evangelos P. Skoures, Detroit, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days. days.

(21) Appl. No.: 15/054,371

(22) Filed: Feb. 26, 2016

(65) Prior Publication Data

US 2017/0249797 A1 Aug. 31, 2017

(51) Int. Cl.

| | |
|---|---|
| ***E05F 15/611*** | (2015.01) |
| ***E05F 15/12*** | (2006.01) |
| ***G07F 17/00*** | (2006.01) |
| ***G08G 1/00*** | (2006.01) |
| ***E05F 15/73*** | (2015.01) |
| ***E05F 15/60*** | (2015.01) |
| ***E05F 15/40*** | (2015.01) |
| ***G07B 15/00*** | (2011.01) |

(52) U.S. Cl.

CPC ..... *G07F 17/0057* (2013.01); *E05F 15/40* (2015.01); *E05F 15/60* (2015.01); *E05F 15/73* (2015.01); *G07B 15/00* (2013.01); *G08G 1/202* (2013.01); *E05Y 2900/518* (2013.01); *E05Y 2900/531* (2013.01)

(58) Field of Classification Search

CPC ..... G07F 17/0057; E05F 15/12; E05F 15/611; E05F 15/40; G07B 15/00; G08G 1/00; G08G 1/0112; B60R 25/24; B60J 5/0416; E05D 11/08

See application file for complete search history.

(56) References Cited

U.S. PATENT DOCUMENTS

| | | | |
|---|---|---|---|
| 4,234,833 | A | 11/1980 | Barrett |
| 5,920,057 | A | 7/1999 | Sonderegger et al. |
| 6,184,641 | B1 | 2/2001 | Crimmins et al. |
| 6,919,804 | B1 | 7/2005 | Cook et al. |
| 7,129,597 | B2 | 10/2006 | Proefke et al. |
| 8,055,534 | B2 | 11/2011 | Ashby et al. |
| 8,799,038 | B2 | 8/2014 | Chen et al. |
| 9,037,852 | B2 | 5/2015 | Pinkus et al. |

(Continued)

FOREIGN PATENT DOCUMENTS

| | | | | |
|---|---|---|---|---|
| CN | 1438609 | A | 8/2003 | |
| JP | 2005336934 | A * | 12/2005 | ..... E05F 15/12 |

(Continued)

*Primary Examiner* — Yuri Kan

(74) *Attorney, Agent, or Firm* — Jason Rogers; Price Heneveld LLP

(57) ABSTRACT

A vehicle door system for a for-hire vehicle (FHV) and a method of calculating a transport fare includes providing a FHV having an actuator configured to adjust a position of a door relative to a door opening. An apparatus is configured to receive vehicle occupancy data. A controller is configured to process the vehicle occupancy data to determine the vehicle occupancy over the course of a passenger transport. The controller is further configured to calculate a transport fare as a function of the vehicle occupancy over the course of the passenger transport.

19 Claims, 9 Drawing Sheets

(56) References Cited

U.S. PATENT DOCUMENTS 9,797,178 B2 * 10/2017 Elie ..... E05F 15/40
2005/0102903 A1 5/2005 Takahashi
2006/0068840 A1 3/2006 Sherman
2006/0220947 A1 * 10/2006 Kornbichler ..... G01S 13/0209 342/118
2007/0152615 A1 * 7/2007 Newman ..... B60H 1/00735 318/481
2007/0266799 A1 * 11/2007 Sugiura ..... G01L 1/16 73/862.541
2010/0161392 A1 * 6/2010 Ashby ..... G06Q 30/02 705/13
2010/0201505 A1 8/2010 Honary et al.
2011/0176000 A1 7/2011 Budge et al.
2012/0236319 A1 * 9/2012 Gotou ..... G01S 7/497 356/614
2013/0141574 A1 * 6/2013 Dalal et al. ..... G06K 9/00 382/103
2013/0166188 A1 * 6/2013 Zheng ..... G08G 1/0112 701/117
2014/0067490 A1 3/2014 James et al.
2014/0074566 A1 3/2014 McCoy et al.
2014/0167445 A1 * 6/2014 Uebelein ..... B60J 5/0416 296/146.2
2014/0313057 A1 * 10/2014 Kokal ..... G07B 15/063 340/928
2015/0059250 A1 * 3/2015 Miu ..... E05F 15/611 49/349
2015/0116085 A1 * 4/2015 Juzswik ..... B60R 25/24 340/5.72
2016/0032624 A1 * 2/2016 Bendel ..... E05D 11/08 49/31

FOREIGN PATENT DOCUMENTS

WO 2007068152 A1 6/2007
WO 2014053900 A2 4/2014

* cited by examiner

MULTI-PASSENGER DOOR DETECTION FOR A PASSENGER TRANSPORT

FIELD OF THE INVENTION

The present invention generally relates to vehicles having automated door opening and closure mechanisms, and more particularly, to methods of calculating transport fares as a function of vehicle occupancy using the automated door mechanisms.

BACKGROUND OF THE INVENTION

Autonomous vehicles are being developed for passenger transport and are being considered for providing services akin to a for-hire vehicle (FHV) or taxi service. These types of services generally require rate calculations that often include variables such as distance traveled, vehicle occupancy, transport duration and number of stops. Without an operator present, it may be difficult for an autonomous FHV to calculate an accurate number of vehicle occupants, or to precisely calculate fares for a ride sharing situation with intermediary stops between pickup locations and final destinations. Thus, a system is desired in which an autonomous FHV can be used in conjunction with a door power assist device for accurately obtaining information pertinent to particular variables used in a FHV rate calculation. A power assist device for use with the present invention is disclosed in U.S. Pat. No. 9,676,256, hereby incorporated in its entirety.

SUMMARY OF THE INVENTION

One aspect of the present invention includes a vehicle door system for a for-hire vehicle (FHV). The FHV includes an actuator configured to adjust a position of a door relative to a door opening. An apparatus is configured to receive vehicle occupancy data. A controller is configured to process the vehicle occupancy data to determine a real-time vehicle occupancy over the course of a passenger transport. The controller is further configured to calculate a transport fare as a function of the real-time vehicle occupancy over the course of the passenger transport.

Another aspect of the present invention includes a method of calculating a transport fare in a for-hire vehicle (FHV). In one embodiment, the method includes at the steps of (1) providing a FHV having an actuator configured to adjust a position of a door; (2) providing access to the FHV using the actuator to open the door; (3) detecting passenger activity in a detection region adjacent the door; (4) determining a FHV occupancy from data related to the passenger activity; and (5) calculating a transport fare as a function of the FHV occupancy.

Yet another aspect of the present invention includes a method of calculating a transport fare in a for-hire vehicle (FHV). In one embodiment, the method includes at the steps of (1) providing a FHV at a pickup location, the FHV having an actuator configured to adjust a position of a door relative to a door opening; (2) providing access to the FHV using the actuator to open the door based on an authenticated access request signal provided to a controller; (3) monitoring passenger ingress and egress through the door opening; (4) closing the door using the actuator; (5) determining an initial FHV occupancy from the passenger activity; and (6) calculating a transport fare, further including the steps of; (7) determining a destination location; (8) calculating a number of intermediate stops made between the pickup location and the destination location; (9) calculating a number of passenger initiated door open requests sent to the controller; (10) monitoring passenger ingress and egress through the door opening at one or more of the number of the intermediate stops to determine a final FHV; and (11) providing the transport fare calculated in-part based on the final FHV occupancy relative to the initial FHV occupancy.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present disclosure are disclosed herein. However, it is to be understood that the disclosed embodiments are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein the term "passenger transport" relates to a trip, ride or journey taken by a passenger in an autonomous FHV suitable for use with the present invention. Further, as used herein the term "transport fare" relates to a fare or rate calculated by the systems and methods disclosed herein for a passenger transport in such an autonomous for-hire vehicle (FHV), and the term "vehicle occupancy" relates to a number of passengers occupying the FHV at any given time. Also, as used herein, the terms "intermediate stop" or "intermediary stop" are interchangeable and relate to a passenger stop along a passenger transport where passengers are picked up or dropped off between an initial pickup location and a destination location.

The present concept involves systems, methods and devices used for calculating fares charged accordingly with the use of a FHV. Particularly, the present concept relates to autonomous FHV vehicles that can calculate fares according to a number of different variables processed by the FHV. As used in the disclosure of the present concept, the terms "fare", "fee", "toll" or any other like term generally refers to a payment or cost associated with using a FHV. The examples noted below are meant to be exemplary situations in which the present concept can be used. The examples in this disclosure are not meant to limit the scope of the present concept in any manner, and are illustrative only.

Figure 1:
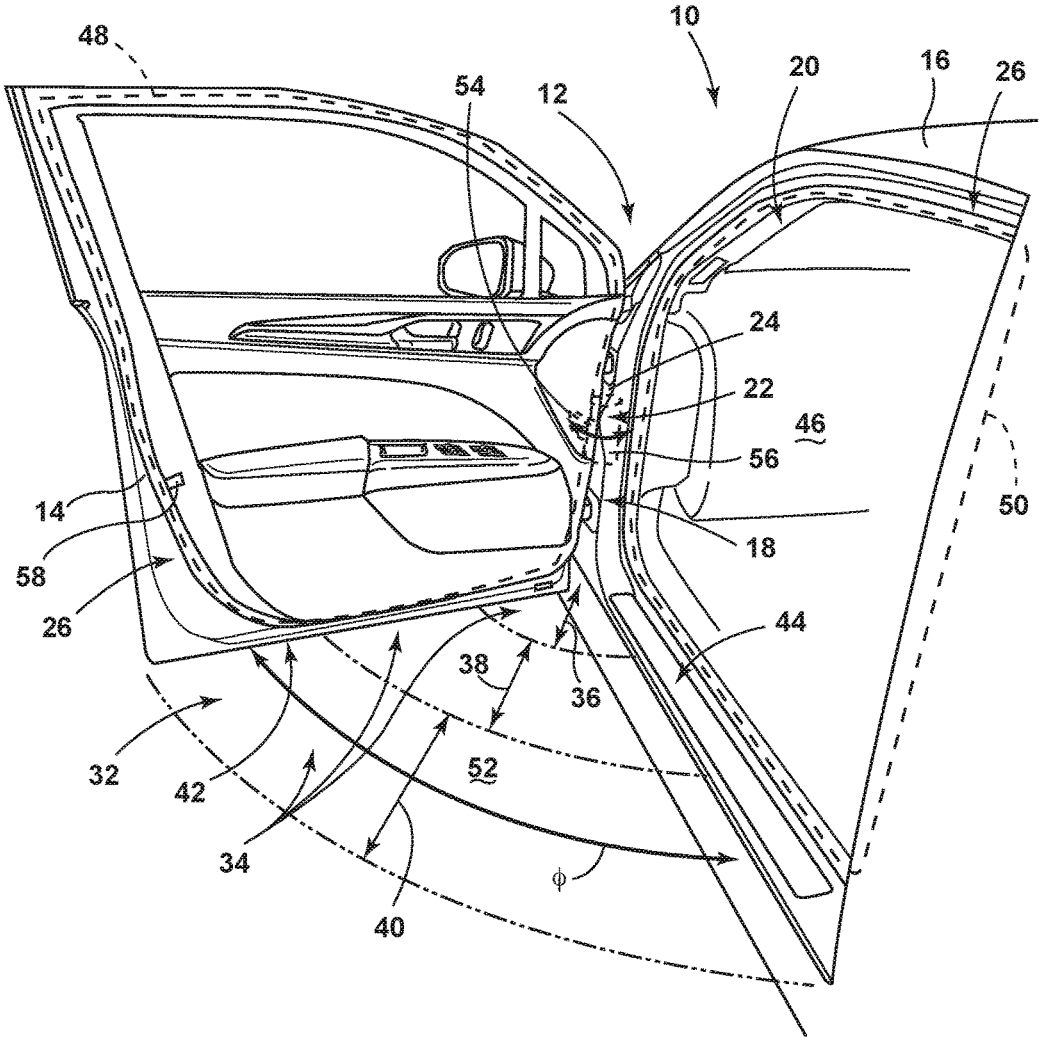
FIG. 1 is a projected view of a vehicle comprising a door assist system configured to detect an object or obstruction in an inner swing path of the door.
Figure 2:
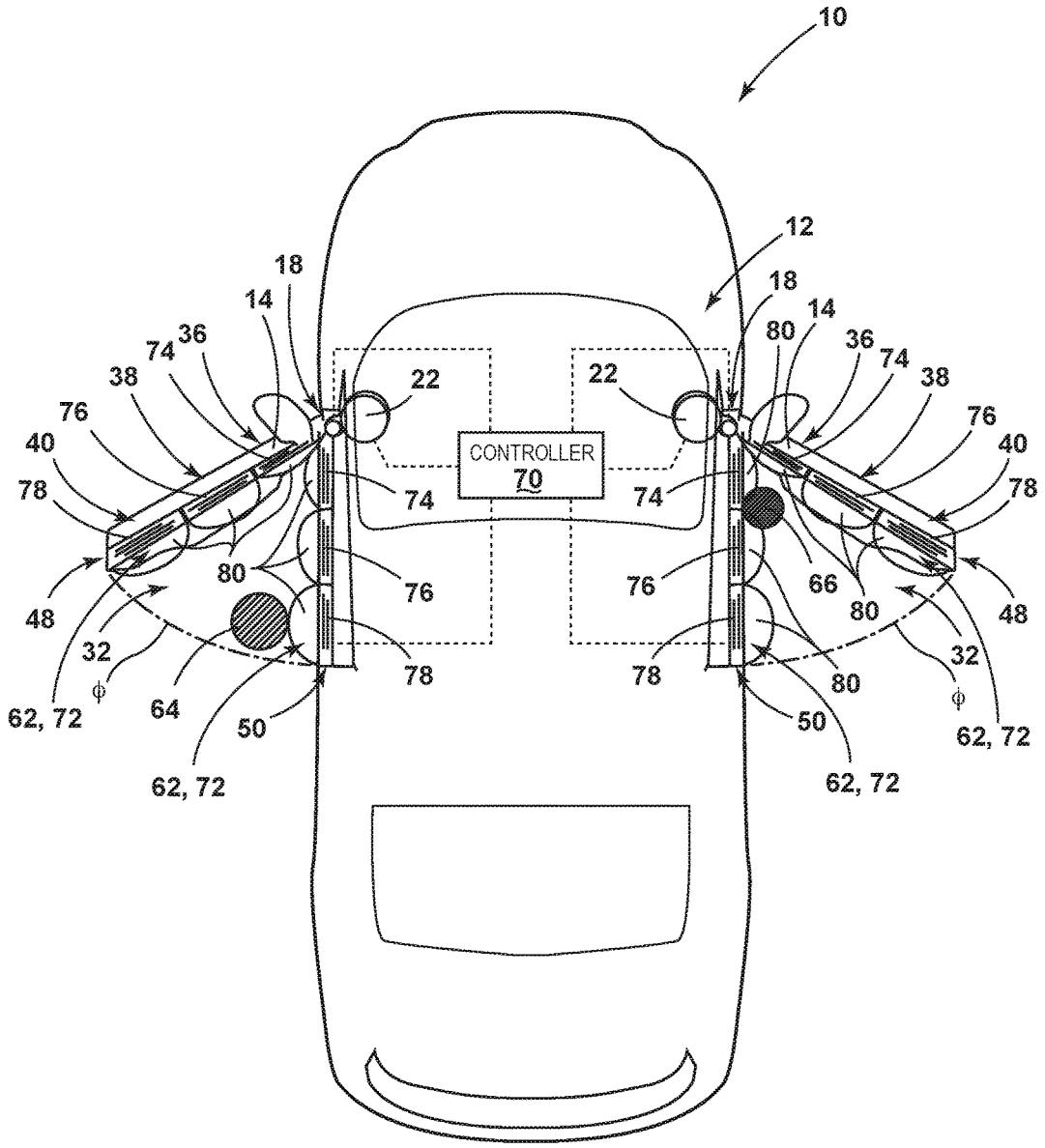
FIG. 2 is a top schematic view of a vehicle comprising a door assist system demonstrating an interference zone of a vehicle door.

Referring now to FIGS. 1 and 2, a vehicle 10 is shown and contemplated to have multiple doors 14, such as found on a four-door sedan. The vehicle 10 is contemplated to be a for-hire vehicle (FHV) or taxi for which a transport fare is generated for transporting passengers. Further, the vehicle 10 is contemplated to be an autonomous vehicle or operator-less vehicle that is configured to transport passengers in a fully automated manner without the presence of an on-board driver or operator.

Figure 3:
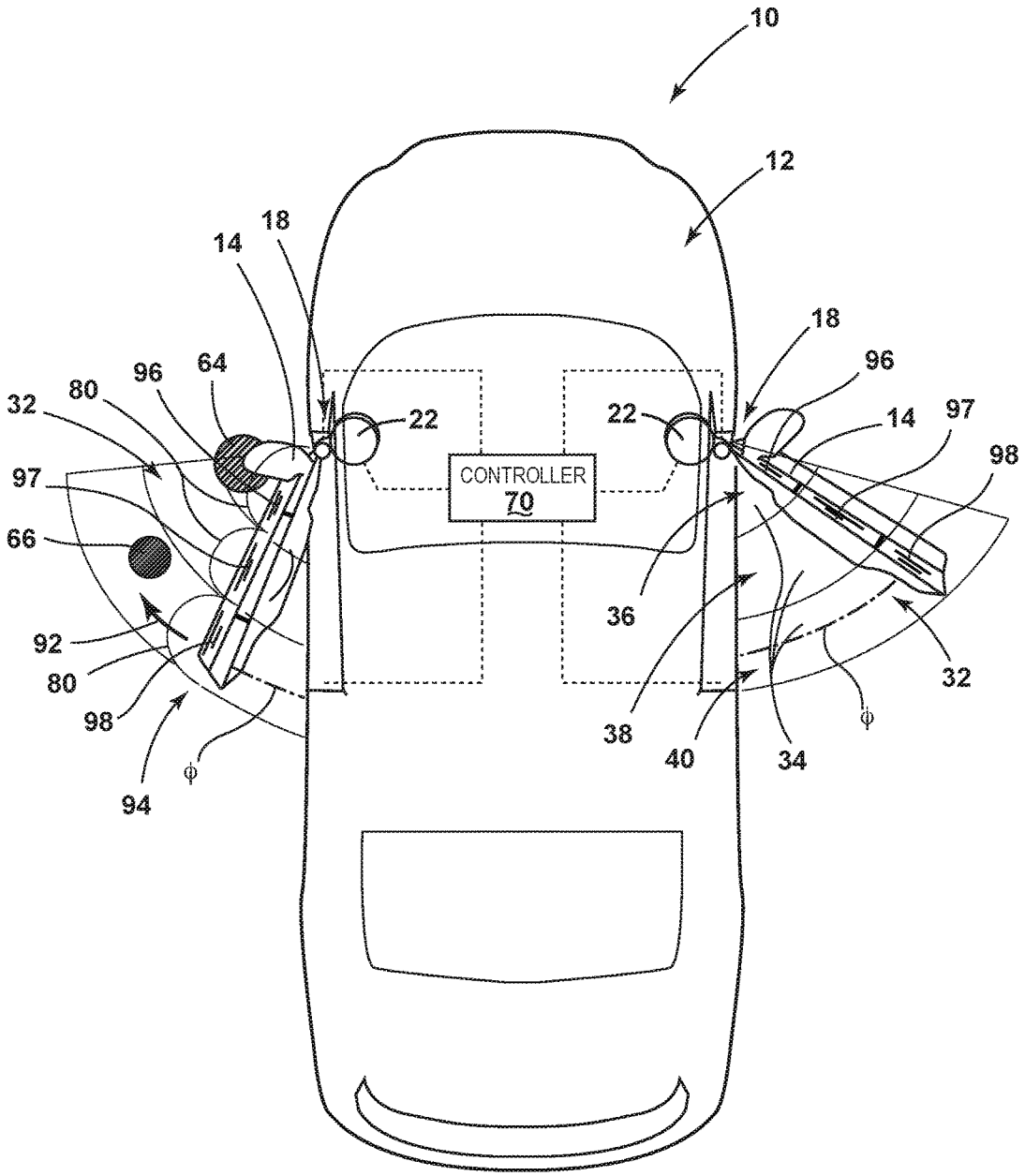
FIG. 3 is a top schematic view of a vehicle comprising a door assist system configured to detect an object or obstruction in an outer swing path of the door.

With specific reference to FIG. 1, the vehicle 10 includes a door opening 20, with one of the doors 14 mounted adjacent to the door opening 20. The door 14 is moveable relative to the door opening 20 between a closed position (FIG. 4) and a range of open positions (FIGS. 1-3). The vehicle 10 also includes a controller that determines whether an instantaneous door position is the closed position or is within the range of open positions and prevents vehicle movement, engine ignition, or both in response to the door 14 being detected as positioned within the range of open positions. The controller is further discussed below and denoted as the controller 70 in FIG. 2.

An actuator 22 is in communication with a controller 70 (shown in FIG. 2) configured to detect and control the angular position $\phi$ of the door 14. In an embodiment, the actuator 22 may be a power assist device that is disposed adjacent to the door 14 and is operably and structurally coupled to the door 14 for assisting in moving the door 14 between open and closed positions, as further described below. The power assist device 22 is coupled to the door 14 for movement therewith and is operably coupled to the hinge assembly 18 for powering the movement of the door 14 between the open and closed positions. As used in an autonomous FHV 10, the power assist device or actuator 22 can provide access to the interior 46 of the FHV 10 for passenger ingress or egress. The power assist device or actuator 22 may include a motor, which is contemplated to be an electric motor, power winch, slider mechanism or other actuator mechanism having sufficient power necessary to provide the torque required to move the door 14 between open and closed positions, as well as various detent locations. Thus, the motor is configured to act on the door 14 at or near the hinge assembly 18 in a pivoting or rotating manner. The controller 70 may comprise a motor control unit comprising a feedback control system configured to accurately position the door 14 about the hinge assembly 18 in a smooth and controlled motion path. The controller 70 may further be in communication with a door position sensor 24 as well as at least one interference sensor 26. The door position sensor 24 may be configured to identify an angular position of the door 14 and the interference sensor 26 may be configured to identify a potential obstruction which may be contacted by the door 14 in motion. Further, the interference sensor 26 may be included in a system used to detect and calculate the number of passengers occupying an autonomous FHV, as discussed below.

The actuator 22 is configured to adjust the door 14 from an opened position, as shown in FIG. 1, to a closed position (FIG. 4) and control the angular position $\phi$ of the door 14 therebetween. The actuator 22 may be any type of actuator that is capable of transitioning the door 14 about the hinge assembly 18, including, but not limited to, electric motors, servo motors, electric solenoids, pneumatic cylinders, hydraulic cylinders, etc. The actuator 22 may be connected to the door 14 by gears (e.g., pinion gears, racks, bevel gears, sector gears, etc.), levers, pulleys, or other mechanical linkages. The actuator 22 may also act as a brake by applying a force or torque to prevent the transitioning of the door 14 between the opened position and the closed position. The actuator 22 may include a friction brake to prevent the transition of the door 14 about the hinge assembly 18.

The position sensor 24 may correspond to a variety of rotational or position sensing devices. In some embodiments, the position sensor 24 may correspond to an angular position sensor configured to communicate the angular position $\phi$ of the door to the controller. The angular position $\phi$ may be utilized by the controller to control the motion of the actuator 22. The door position sensor 24 may correspond to an absolute and/or relative position sensor. Such sensors may include, but are not limited to quadrature encoders, potentiometers, accelerometers, etc. The position sensor 24 may also correspond to optical and/or magnetic rotational sensors. Other sensing devices may also be utilized for the position sensor 24 without departing from the spirit of the disclosure.

Position sensor 24 may be incorporated into the structure of actuator 22 itself, or can otherwise be associated with both door 14 and opening 20. In one example, actuator 22 can include a first portion 54 coupled with the door 14 and a second portion 56 with the vehicle body 16 or frame defining opening 20, such portions being moveable relative to each other in a manner that corresponds to the movement of door 14. Position sensor 24 in the form of a potentiometer, for example, can include respective portions thereof coupled with each of such portions 54, 56 such that movement of the portion coupled with the door 14 can be measured relative to the second portion 56 thereof coupled with the vehicle opening 20 to, accordingly, measure the positioning between door 14 and opening 20. In a similar manner, sensor 24 may have a portion coupled directly with door 14 and another portion coupled directly with the opening 20. Still further, position sensor 24 can be in the form of an optical sensor mounted on either the door 14 or the opening 20 that can monitor a feature of the opposite structure (opening 20 or door 14), a marker, or a plurality of markers to output an appropriate signal to controller 70 for determination of angular position $\phi$. In one example, an optical sensor used for position sensor 24 can be positioned such that actuator 22 is in a field of view thereof such that the signal output thereby can correspond directly to a condition of actuator 22 or a relative position of first portion 54 thereof relative to opening 20.

The interference sensor 26 may be implemented by a variety of devices, and in some implementations may be utilized in combination with the actuator 22 and the position sensor 24 to detect and control the motion of the door 14. The interference sensor 26 may correspond to one or more capacitive, magnetic, inductive, optical/photoelectric, laser, acoustic/sonic, radar-based, Doppler-based, thermal, and/or radiation-based proximity sensors. In some embodiments, the interference sensor 26 may correspond to an array of infrared (IR) proximity sensors configured to emit a beam of IR light and compute a distance to an object in an interference zone 32 based on characteristics of a returned, reflected, or blocked signal. The returned signal may be detected using an IR photodiode to detect reflected light emitting diode (LED) light, responding to modulated IR signals, and/or triangulation.

In some embodiments, the interference sensor 26 may be implemented as a plurality of sensors or an array of sensors configured to detect an object in the interference zone 32. Such sensors may include, but are not limited to, touch sensors, surface/housing capacitive sensors, inductive sensors, video sensors (such as a camera), light field sensors, etc. As disclosed in further detail in reference to FIGS. 2 and 3, capacitive sensors and inductive sensors may be utilized to detect obstructions in the interference zone 32 of the door 14 of the vehicle 10 to ensure that the door 14 is properly positioned by the actuator 22 from the open position to the closed position about the hinge assembly 18.

The interference sensor 26 may be configured to detect objects or obstructions in the interference zone 32 in a plurality of detection regions 34. For example, the detection regions 34 may comprise a first detection region 36, a second detection region 38, and a third detection region 40 that are serially aligned as shown in FIG. 1. In this configuration, the interference sensor 26 may be configured to detect the presence of an object in a particular detection region and communicate the detection to the controller such that the controller may control the actuator 22 accordingly. The detection regions 34 may provide information regarding the position of an object or obstruction to accurately respond and control the actuator 22 to change a direction or halt movement of the door 14 prior to a collision with the object. Monitoring the location of an object or obstruction relative to a radial extent 42 of the door 14 in relation to the hinge assembly 18 may significantly improve the control of the motion of the door 14 by allowing for variable sensitivities of each of the detection regions 34. The interference sensor 26 can also be used to detect passengers entering or exiting the interior 46 of the FHV 10, as further described below.

The variable sensitives of each of the detection regions 34 may be beneficial due to the relative motion and force of the door 14 as it is transitioned about the hinge assembly 18 by the actuator 22. The first detection region 36 may be the most critical because the actuator 22 of the door assist system 12 has the greatest leverage or torque closest to the hinge assembly 18. For example, a current sensor utilized to monitor the power delivered to the actuator 22 would be the least effective in detecting an obstruction very close to the hinge assembly 18. The limited effect of the current sensor may be due to the short moment arm of the first detection region 36 relative to the hinge assembly 18 when compared to the second detection region 38 and the third detection region 40. As such, the interference sensor 26 may have an increased sensitivity in the first detection region 36 relative to the second and third regions 38 and 40 to ensure that objects are accurately detected, particularly in the first detection region 36. In this way, the system 12 may facilitate accurate and controlled motion and ensure the greatest accuracy in the detection of objects while limiting false detections.

Though depicted in FIG. 1 as being configured to monitor a lower portion of the door 14 proximate a door sill 44, the interference sensor 26 may be configured to monitor an access region and a door opening 20 proximate a perimeter door seal 48 and/or a perimeter door opening seal 50. For example, the interference sensor 26 may correspond to a sensor or sensor array configured to monitor each of the detection regions 36, 38, and 40 for an object that may obstruct the motion of the door 14 by the actuator 22. The interference sensor 26 may be configured to monitor an entry region 52 of the vehicle 10 corresponding to a volumetric space formed between the door 14 and the body 16. A sensory region of the interference sensor 26 may particularly focus on interface surfaces proximate the perimeter door seal 48 and the perimeter door opening seal 50. In this way, a passenger entering or exiting, or generally moving towards or away from the interior 46 of the FHV 10, can be detected.

As discussed further herein, the interference sensor 26 may be implemented by a variety of systems operable to detect objects and/or obstructions in the interference zone 32, entry region 52, and/or any region proximate the door 14 throughout the operation of the door assist system 12. Though the door assist system 12 is demonstrated in FIG. 1 having the detection regions 34 configured to detect an object located in an inner swing path between the door 14 and the body 16 of the vehicle 10, the system 12 may also be configured to detect an object or obstruction in an outer swing path of the door 14. Further details regarding such embodiments are discussed in reference to FIG. 4.

Referring to FIGS. 1 and 2, an exemplary embodiment of an interference sensor 62 is shown. The interference sensor 62 may correspond to the interference sensor 26 introduced in FIG. 1. The interference sensor 62 may be disposed proximate at least one of the perimeter door seals 48 and the perimeter door opening seal 50. In some embodiments, the interference sensor 62 may correspond to one or more proximity sensors or capacitive sensors configured to detect an object. As shown in FIG. 2, the object may correspond to a first object 64 and/or a second object 66 in the entry region 52 proximate the door 14 and/or the body 16. The one or more capacitive sensors may be configured to detect objects that are conductive or having dielectric properties different from air. In this configuration, the interference sensor 62 is configured to communicate the presence of any such objects to the controller 70 such that the controller 70 can limit motion of the actuator 22 to prevent a collision between the door 14 and the objects 64 and 66.

The interference sensor 62 may correspond to a plurality of proximity sensors or a sensor array 72 comprising a first proximity sensor 74 configured to monitor the first detection region 36, a second proximity sensor 76 configured to monitor the second detection region 38, and a third proximity sensor 78 configured to monitor the third detection region 40. The sensor array 72 may be in communication with the controller 70 such that each of the proximity sensors 74, 76, and 78 are operable to independently communicate a presence of the objects 64 and 66 in an electric field 80 defining each of their respective sensory regions. In this configuration, the controller 70 may be configured to identify objects in each of the detection regions 36, 38, and 40 at different sensitivities or thresholds. Additionally, each of the proximity sensors 74, 76, and 78 may be controlled by the controller 70 to have a particular sensory region corresponding to a proximity of a particular proximity sensor to the hinge assembly 18 and/or an angular position $\phi$ of the door 14.

The controller 70 may further be configured to identify a location of at least one of the objects 64 and 66 in relation to a radial position of the objects 64 and/or 66 along a length of the door 14 extending from the hinge assembly 18. The location(s) of the object(s) 64 and/or 66 may be identified by the controller 70 based on a signal received from one or more of the proximity sensors 74, 76, and 78. In this way, the controller 70 is configured to identify the location(s) of the object(s) 64 and/or 66 based on a position of the proximity sensors 74, 76, and 78 on the door 14. In some embodiments, the controller 70 may further identify the location(s) of the object(s) 64 and/or 66 based on the signal received from one or more of the proximity sensors 74, 76, and 78 in combination with an angular position $\phi$ of the door 14.

In some embodiments, the controller 70 may be configured to identify an object in each of the detection regions 36, 38, and 40 at a different sensitivity. The controller 70 may be configured to detect an object in the first detection region 36 proximate the first proximity sensor 74 at a first sensitivity. The controller 70 may be configured to detect an object in the second detection region 38 proximate the second proximity sensor 76 at a second sensitivity. The controller 70 may also be configured to detect an object in the third detection region 40 proximate the third proximity sensor 78 at a third sensitivity. Each of the sensitivities discussed herein may be configured to detect the objects 64 and 66 at a particular predetermined threshold corresponding to signal characteristics and/or magnitudes communicated from each of the proximity sensors 74, 76, and 78 to the controller 70.

The first proximity sensor 74 may have a lower detection threshold than the second proximity sensor 76. The second proximity sensor 76 may have a lower threshold than the third proximity sensor 78. The lower threshold may correspond to a higher or increased sensitivity in the detection of the objects 64 and 66. In this configuration, the proximity sensors 74, 76, and 78 may be configured to independently detect objects throughout the interference zone 32 as the position of the door 14 is adjusted by the actuator 22 about the hinge assembly 18.

Each of the proximity sensors 74, 76, and 78 may also be configured to have different sensory ranges corresponding of their respective detection regions 36, 38, and 40. The sensory regions of each of the proximity sensors 74, 76, and 78 may be regulated and adjusted by the controller 70 such that the electric field 80 defining each of their respective sensory regions may vary. The controller 70 may adjust a range of a sensory region or an electric field 80 of the proximity sensors 74, 76, and 78 by adjusting a voltage magnitude supplied to each of the proximity sensors 74, 76, and 78. Additionally, each of the proximity sensors 74, 76, and 78 may be configured independently having different designs, for example different sizes and proportions of dielectric plates to control a range of the electric field 80 produced by a particular sensor. As described herein, the disclosure provides for a highly configurable system that may be utilized to detect a variety of objects in the interference zone 32.

The interference sensor 62 may also be implemented by utilizing one or more resistive sensors. In some embodiments, the interference sensor 62 may correspond to an array of capacitive sensors and resistive sensors in combination configured to monitor the interference zone 32 for objects that may obstruct the operation of the door 14. In yet another exemplary embodiment, the interference sensor 62 may be implemented in combination with at least one inductive sensor as discussed in reference to FIG. 3. As such, the disclosure provides for an interference sensor that may be implemented utilizing a variety of sensory techniques and combinations thereof to ensure that objects are accurately detected in the interference zone 32.

Still referring to FIGS. 1 and 2, in some embodiments, the interference sensor 62 may be incorporated as an integral component of at least one of the perimeter door seal 48 and the perimeter door opening seal 50. For example, the interference sensor 62 may correspond to a plurality of proximity sensors or an array of proximity sensors incorporated as an integral layer of at least one of the perimeter door seal 48 and the perimeter door opening seal 50. This particular embodiment of the interference sensor 62 may comprise a similar structure to the sensor array 72, discussed in reference to FIG. 6. In such embodiments, the interference sensor 62 may be implemented as a capacitive sensor array configured to detect objects proximate at least one of the perimeter door seal 48 and the perimeter door opening seal 50.

The perimeter door seal 48 and/or the perimeter door opening seal 50 may comprise an outer layer having the proximity sensors 74, 76, and 78 of the sensor array 72 proximate thereto or in connection therewith. The outer layer may correspond to a flexible or significantly rigid polymeric material having the interference sensor 62 connected thereto. In some embodiments, the sensor array 72 may also be disposed proximate the perimeter door seal 48 and/or the perimeter door opening seal 50 on the door 14 and/or the body 16 respectively. In this configuration, the plurality of proximity sensors of the sensor array 72 may be utilized to detect an object in any of the detection regions 36, 38, and 40. This configuration may further provide for the interference sensor 62 to be conveniently incorporated into the perimeter door seal 48 and/or the perimeter door opening seal 50 for ease of implementation of the door assist system 12.

Referring to FIG. 3, a top schematic view of the vehicle 10 comprising the door assist system 12 is shown. As discussed previously, the door assist system 12 may further be configured to detect the objects 64 and 66 in an outer swing path 92 of the door 14. In this configuration, the controller 70 may be configured to control the actuator 22 to adjust the angular position $\phi$ of the door 14 of the vehicle 10 from a closed position to an opened position. As discussed previously, the interference sensor 26 may correspond to a sensor array 94 comprising a plurality of proximity sensors. Each of the proximity sensors may be configured to detect the objects 64 and 66 in the outer swing path 92 of the door 14. The plurality of proximity sensors of the sensor array 94 correspond to a first proximity sensor 96, a second proximity sensor 97, and a third proximity sensor 98. In this configuration, the controller 70 may be configured to detect the objects 64 and 66 in the plurality of detection regions 34 of the interference zone 32 corresponding to the outer swing path 92 of the door as well as the inner swing path as discussed in reference to FIG. 1.

The interference sensor 26 may be configured to identify a location of each of the objects 64 and 66 based on the position of the objects 64 and 66 relative to each of the detection regions 34 and the angular position $\phi$ of the door 14. That is, the controller 70 may be configured to identify and monitor the location of the objects 64 and 66 relative to the radial extent 42 of the door 14 in relation to the hinge assembly 18. The controller 70 may identify and monitor the location of the objects based on a detection signal for each of the objects received from one or more of the proximity sensors 96, 97, and 98. Based on the detection signal from one or more of the proximity sensors 96, 97, and 98, the controller 70 may identify the location of the objects based on the position of each of the proximity sensors 96, 97, and 98 along the radial extent 42 of the door 14. The controller 70 may further identify the location of the objects based on the angular position $\phi$ communicated from the door position sensor 24. In this configuration, the door assist system 12 may be configured to position the door 14 from a closed position to an opened position while preventing the door 14 from striking the objects 64 and 66.

In some embodiments, the controller 70 may further be operable to prioritize a first detection of the first object 64 and a second detection of the second object 66. For example as illustrated in FIG. 3, the controller 70 may identify that the door 14 is closer to the first object 64 than the second object 66 in relation to the rotational path of the door 14 about the hinge assembly 18. The controller 70 may identify that the first object 64 is closer than the second object based on a proximity of each of the objects 64 and 66 to the door 14 as determined via one or more signals received by the controller 70 from the interference sensor 26. The controller 70 may monitor the proximity of each of the objects 64 and 66 throughout an adjustment of the angular position $\phi$ of the door 14 based on the one or more signals. Once the controller 70 detects that a proximity signal from at least one of the proximity sensors 96, 97, and 98 exceeds a predetermined threshold, the controller 70 may control the actuator 22 to halt a positioning adjustment of the door 14. In this way, the controller 70 may prioritize a control instruction to control the actuator 22 to limit the angular position $\phi$ of the door 14 to prevent a collision between the door 14 and one or more objects 64 and 66 in the interference zone 32.

As noted above, the vehicle 10 is contemplated to be an autonomous vehicle for transporting passengers from a pickup location to a final destination. The components of the door assist system 12 described herein are further used to help calculate rate or fare information particular to occupants of the vehicle 10 for a given passenger transport. For instance, the actuator 22 is configured to open one of the doors 14 of the vehicle 10 for entry of a passenger when the vehicle 10 has arrived at a pickup location. The door 14 can open when a passenger is detected using the proximity sensors 96, 97, 98 of sensor array 94 (FIG. 3). Further, a passenger can be detected using an authentication system described below.

Figure 4:
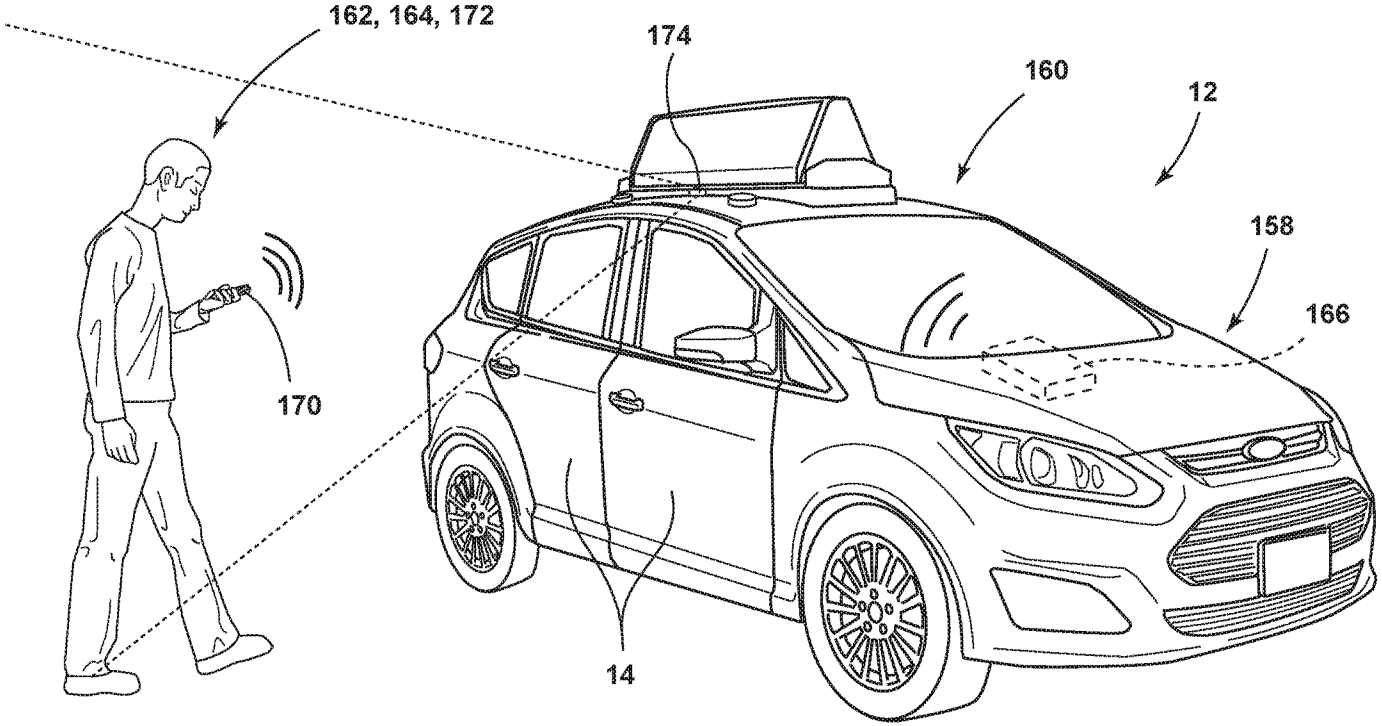
FIG. 4 is an environmental view of a vehicle passenger approaching an autonomous vehicle equipped with a door control system.

Referring now to FIG. 4, an environmental view of a passenger P approaching a vehicle 160 is shown. The vehicle 160 may be similar to the FHV 10 described above, wherein reference numerals refer to like-numbered elements for clarity. Accordingly, the vehicle 160 may be an autonomous FHV having the door assist system 12 and/or a fully automatic door system as discussed herein. Accordingly, the door actuator 22 may be operable to generate a torque or force required to position the door 14 between open and closed positions, as well as various detent positions. The vehicle 160 may correspond to transport vehicle, for example a shuttle, bus, chauffeured vehicle, autonomous vehicle, etc. Embodiments of the vehicle 160 that support autonomous operation may comprise an autonomous operation system 158. As discussed herein, the autonomous operation system 158 may be configured to process a position, trajectory, roadway, and map data to determine a path of travel for vehicle 160. In this way, the vehicle 160 may be configured to travel to a first location (e.g. a pickup location), pick-up a passenger, and travel to a second location (e.g. a destination). Transport rate calculations are also provided below for trips having intermediary stops and dynamic passenger occupancy.

The vehicle 160 may comprise one or more door actuators 22 configured to selectively position one or more of the doors 14. In this configuration, the vehicle 160 may enable a potential passenger P to access the vehicle 160. As discussed herein, the controller 70 may be operable to control the door actuators 22 to provide for powered operation of the doors 14. Additionally, in some embodiments, the controller 70 may be configured to authenticate or verify that the potential passenger P is an authorized passenger 164. In this way, the controller 70 may be operable to confirm or authenticate an identity of the potential passenger P prior to making the vehicle 160 accessible. For example, the controller 70 may control the one or more door actuators 22 to open at least one door 14 of the vehicle 160 in response to the authentication.

Though discussed in reference to the vehicle 160 comprising the one or more actuators 22 to provide for automatic or power operation of the doors 14, the controller 70 may similarly be configured to grant access to the vehicle 160. For example, in response to a positive response to the authentication system, the controller 70 may be configured to unlock the doors 14 and/or output a message to an operator of the vehicle 160 confirming the identity of the potential passenger P. In this way, the systems and methods discussed herein may provide for an authentication of the potential passenger P for a variety of applications.

The controller 70 may comprise a communication circuit 166. The communication circuit 166 may correspond to a wireless receiver and/or transmitter configured to communicate with a mobile device 170. In this configuration, the controller 70 may receive a first communication in the form of a request from the mobile device 170 identifying a pickup for transportation of a patron 172 from a first location. The first communication may further comprise authentication information configured to authenticate an identity of the patron 172. The authentication information may be utilized upon pickup of the patron 172 to ensure that the potential passenger P is the patron 172 and accordingly, the authorized occupant 164.

The authentication information may correspond to any characteristic of the potential passenger P and/or the mobile device 170 that may be utilized to authenticate the identity of the potential passenger P. The authentication information may be captured by the mobile device 170 via standard usage (e.g. voice data gathered via a microphone). Additionally, the mobile device 170 may be configured to request and/or store the information, for example height or other information that may be manually entered. The mobile device 170 may further comprise one or more sensor devices similar to those discussed in reference to the controller 70 (e.g. a finger print scanner, imager, etc.) that may be utilized to capture authentication information that may later be utilized by the controller to authenticate the potential passenger P.

Upon detection of the potential passenger P, the controller 70 may be configured to utilize the communication circuit 166 and/or a sensor device 174 to authenticate the potential passenger P to be the patron 172. In response to the authentication, the controller 70 may be configured to control the door actuators 22 and/or additional vehicle systems (e.g. door locks, etc.) to allow the authenticated occupant 164 to enter the vehicle 160. In this configuration, the controller 70 may provide for secure operation of the vehicle 160.

The communication circuit 166 may correspond to one or more circuits that may be configured to communicate via a variety of communication methods or protocols. For example, the communication circuit 166 may be configured to communicate in accordance with one or more standards including, but not limited to 3GPP, LTE, LTE Advanced, IEEE 802.11, Bluetooth, advanced mobile phone services (AMPS), digital AMPS, global system for mobile communications (GSM), code division multiple access (CDMA), local multi-point distribution systems (LMDS), multi-channel-multi-point distribution systems (MMDS), radio frequency identification (RFID), Enhanced Data rates for GSM Evolution (EDGE), General Packet Radio Service (GPRS), and/or variations thereof. In some embodiments, the communication circuit 166 may further be configured to receive a first communication from the mobile device 170 via a first protocol and a second communication via a second protocol. The first protocol may correspond to a long-range communication protocol and the second protocol may correspond to a short-range or local communication protocol.

The long-range communication protocol may correspond to a mobile data or cellular communication including, but not limited to a cellular or broadband wireless communication and similar communication methods (e.g. GSM, CDMA, WCDMA, GPRS, WiFi, WiMax, 3G, 4G, etc.). The short-range communication protocol may correspond to a local wireless interface between the mobile device 170 and the controller 70. For example, a short-range communication protocol may correspond to a radio communication interface including, but not limited to RFID, Bluetooth™, ANT+, NFC, ZigBee, infrared, ultraband, etc. In general, a short-range communication protocol, as discussed herein, may correspond to a communication method that has a typical range of less than 1 km and may correspond to a communication method having a range of less than 100 m.

The second communication via the second protocol may be utilized to ensure that the authentication of the potential passenger P as the authenticated occupant 164 originates from the patron 172 or an associated party local to the vehicle 160. In this configuration, the patron 172 may request the vehicle 160 for transport via the first protocol or the long-range protocol while the patron 172 is any distance from the vehicle 160. The authentication of the patron 172 may require that the patron 172 is local to the vehicle 160. This process may provide for the patron 172 to be accurately identified by the controller 70 by comparing the authentication information received in the first communication from the mobile device 170 to authentication information received in the second communication from the mobile device 170.

The sensor device 174 may also be utilized to authenticate that the potential passenger P corresponds to the patron 172. The sensor device 174 may be utilized alone or in combination with the second communication to authenticate the identity of the patron 172. In general, the sensor device 174 may correspond to a device configured to capture identity information related to the potential passenger P in order to authenticate the identity of the patron 172. The identity information may be compared by the controller 70 to the authentication information received in the first communication to authenticate the identity of the patron 172. For clarity, the authentication via the second communication may be referred to as the first authentication, and the authentication via the sensor device 174 may be referred to as the second authentication. However, each of the methods discussed herein may be utilized alone or in any combination without departing from the spirit of the disclosure.

The sensor device 174 may correspond to any form of data acquisition device or any combination of sensory devices that may be in communication with the controller 70. The sensor device 174 may correspond to a device configured to capture image data, for example an imager, video camera, infrared imager, scanner, or any device configured to capture text, graphics images, and/or video data. In some embodiments, the sensor device 174 may correspond to a device configured to capture voice or any form of audio data, for example a microphone, audio decoder, and/or an audio receiver. The sensor device 174 may also correspond to a capacitive, image based, and/or pressure based sensor configured to scan a finger print. An image sensor may be configured to identify a facial feature, height, profile shape, iris pattern or any other form of visual data.

The controller 70 may receive captured data from one or more sensor devices as discussed herein (e.g. sensor device 174). In response to receiving the captured data, the controller 70 may compare the captured data to the authentication information received in the first communication to authenticate the identity of the patron 172. Accordingly, the controller 70 may comprise one or more processors configured to analyze the captured data and compare the captured data to the authentication information. In this way, the controller 70 may provide for an authentication of the authenticated passenger 164 and selectively activate at least one of the door actuators 22 to ensure secure access to the vehicle 160.

Figure 5:
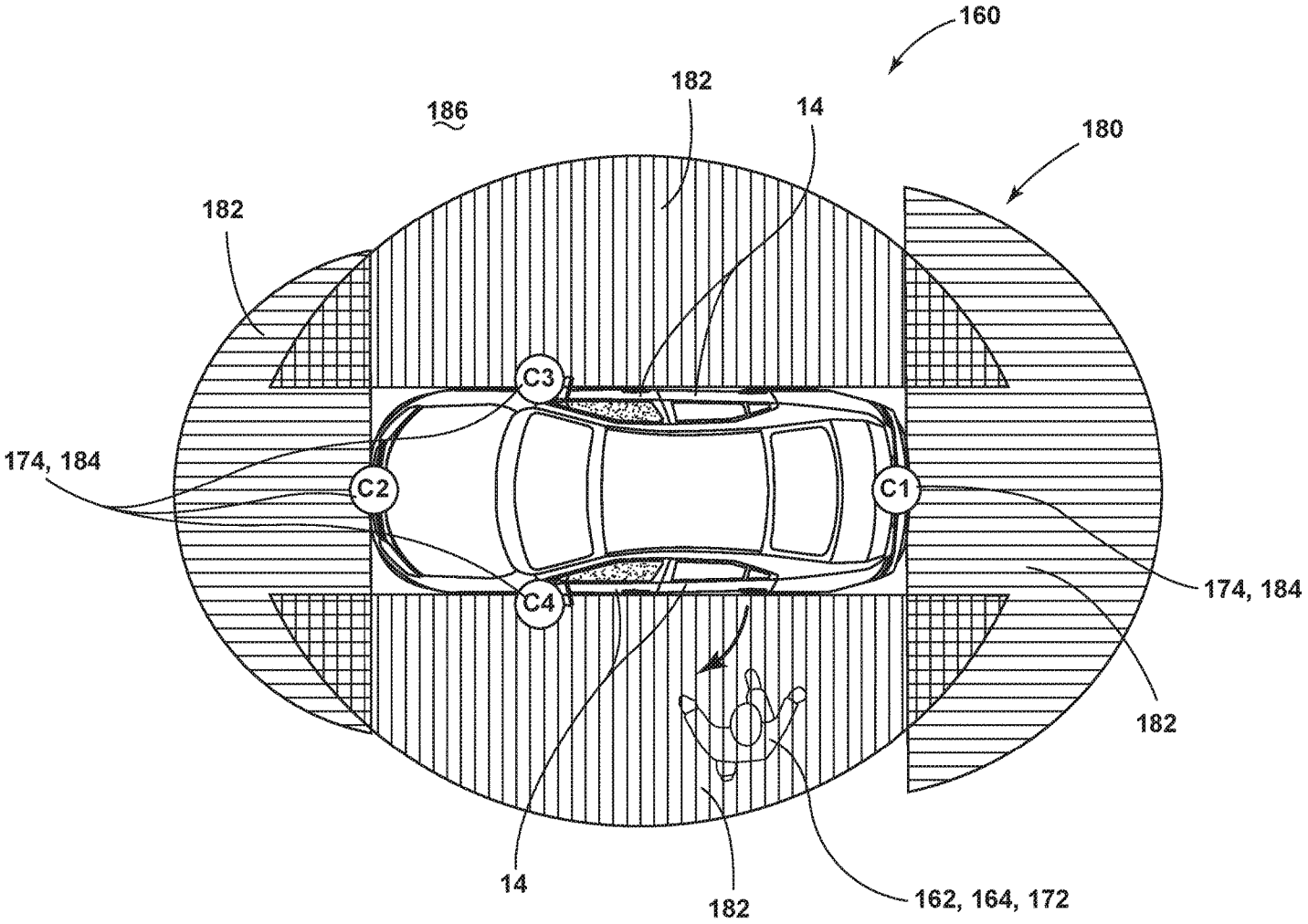
FIG. 5 is a schematic diagram of an autonomous vehicle comprising a plurality of sensor devices for use with a door control system.

Referring now to FIG. 5, an embodiment of the vehicle 160 comprising a plurality of sensor devices 174 in the form of a camera system 180. The camera system 180 may be implemented with the vehicle 160 to capture image data for display on one or more display screens of the vehicle. In some embodiments, the image data may correspond to a region proximate the vehicle 160 including at least one field of view 182 of one or more imaging devices 184 or cameras. The one or more imaging devices 184 may correspond to a plurality of imaging devices C1-C4. Each of the imaging devices may have a field of view focusing on an environment 186 proximate the vehicle 160. In the various implementations discussed herein, the imaging devices C1-C4 may be implemented to provide views of the environment 186 proximate the vehicle 160 that may be displayed on a display screen (e.g. HMI 128) or any form of display device some of which may be visible to an operator of the vehicle 160.

The imaging devices C1-C4 may be arranged in various locations such that each of the fields of view 182 of the imaging devices C1-C4 is configured to capture a significantly different portion of the surrounding environment 186. Each of the imaging devices C1-C4 may comprise any form of device configured to capture image data, for example Charge Coupled Device (CCD) and Complementary Metal Oxide Semiconductor (CMOS) image sensors. Though four imaging devices are discussed in reference to the present implementation, the number of imaging devices may vary based on the particular operating specifications of the particular imaging devices implemented and the proportions and/or exterior profiles of a particular vehicle and trailer. For example, a large vehicle may require additional imaging devices to capture image data corresponding to a larger surrounding environment. The imaging devices may also vary in viewing angle and range of a field of view corresponding to a particular vehicle.

In this configuration, the camera system 180 may be configured to capture image data corresponding to the captured data and compare the captured data to the authentication information. The controller 70 may provide for an authentication of the authenticated passenger 164 and selectively activate at least one of the door actuators 22 to ensure secure access to the vehicle 160. As discussed herein, the controller 70 may be configured to utilize various forms of data that may be communicated to the controller 70 from one or more sources in a local proximity to the vehicle 160. In this way, the controller 70 may provide for the authentication of the identity of the potential passenger P.

Thus, as noted above, the vehicle door assist system 12 can be used with a FHV 10 having an actuator 22 that is configured to adjust a position of a door 14. An apparatus, such as interference sensor 26 or 62 noted above, may be configured to receive vehicle occupancy data. Specifically, the interference sensor 26 may be configured to monitor passenger ingress and egress from the door 14 when the door 14 is in an open position as shown in FIGS. 1-3. The sensor 24 may include a first sensor array 72 comprised of multiple sensors, such as sensors 74, 76 and 78 shown in FIG. 2. The sensors 74, 76 and 78 are disposed about the door opening 20 adjacent to the door 14 and are serially aligned as shown in FIG. 2. In this way, sensor 78 corresponds to detection region 40, while sensor 76 corresponds to detection region 38. Further, sensor 74 corresponds to detection region 36. As a passenger enters the interior 46 of the vehicle 10, the door 14 will be in the open position and sensor 78 will detect the passenger in detection region 40 followed by a detection by sensor 76 detecting the passenger in detection region 38. Similarly, an entering passenger may be detected by sensor 74 in detection region 36. In this way, the first sensor array 72 can detect a passenger entering the interior 46 of the vehicle 10. As a corollary, the serially aligned sensors 74, 76 and 78 of the first sensor array 72 can detect a passenger exiting the vehicle 10 by the consecutive detection within the detection regions 36, 38, and 40, respectively.

With the first sensor array 72 having serially aligned sensors 74, 76 and 78, vehicle occupancy data can be detected by the sensors 74, 76, 78 and sent to the controller 70 for processing. The controller, such as controller 70 shown in FIG. 2, can process the vehicle occupancy data by determining the direction of passenger movement and the number of passengers entering or exiting a particular vehicle door, such as door 14, when the vehicle door is in the open position. At an intermediary stop during a passenger transport, the first sensor array 72 can be used to detect exiting passengers for that particular intermediary stop when the actuator has been triggered to open the door 14. The controller 70 can then recalculate a vehicle occupancy count, such that the vehicle occupancy count is a real-time or dynamic figure over the course of a passenger transport.

Figure 8:
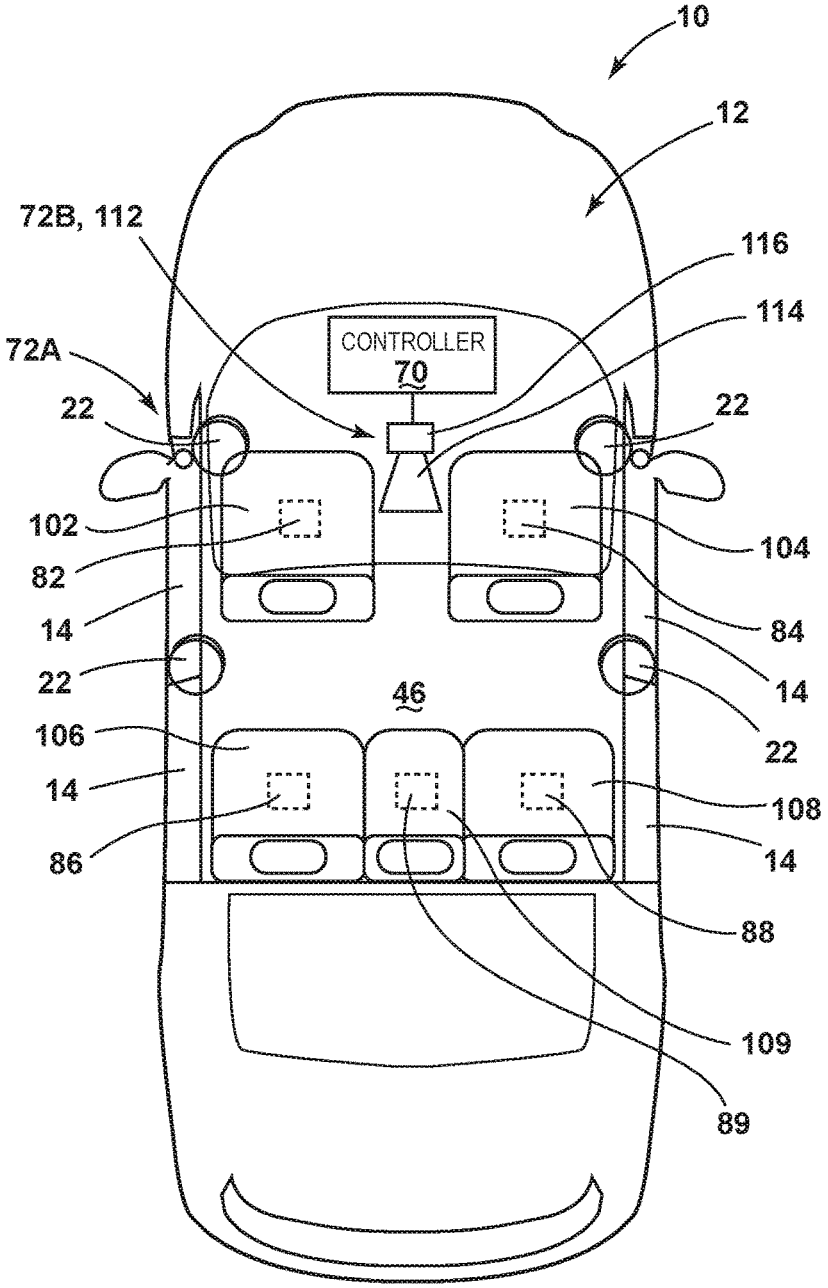
FIG. 8 is a top schematic view of a vehicle comprising a door assist system configured to detect an object or obstruction in an interior of a vehicle using weight sensors associated with a number of vehicle seats.

With reference to FIG. 8, the vehicle 10 may further include a second sensor array 72A which includes a plurality of sensors associated with each seat of a plurality of seats disposed within the interior 46 of the vehicle 10. In this way, the second sensor array 72A may include weight sensors 82, 84, 86, 88 and 89 associated with seats 102, 104, 106, 108 and 109, respectively, that can confirm the vehicle occupancy data obtained by the first sensor array 72. Weight sensors in vehicles are known and will be appreciated by one of ordinary skill in the art for use with the present invention as used as an authentication apparatus for confirming or authenticating the vehicle occupancy data obtained by the first sensor array 72 at the door opening 20 of the vehicle 10. The weight sensors 82, 84, 86, 88 and 89 of the second sensor array 72A can be used to determine an occupancy condition of each seat 102, 104, 106, 108 and 109 disposed within the interior 46 of the vehicle 10 as associated with each weight sensor 82, 84, 86, 88 and 89. Thus, as noted above, the first sensor array 72 can detect a direction of movement of a passenger using the serially aligned sensors 74, 76 and 78 as a passenger moves through the detections regions 36, 38 and 40, respectively, when entering or exiting the vehicle 10. The second sensor array 72A of weight sensors 82, 84, 86, 88 and 89, can be used to confirm an occupancy condition of each seat 102, 104, 106, 108 and 109 within the interior 46 of the vehicle 10 for providing an authenticated vehicle occupancy to the controller 70. Further, the present invention can ensure that the vehicle occupancy does not exceed a maximum capacity for a given FHV. The sensor arrays 72A, 72B can be used to make that determination and the automatic door assist system 12 can leave doors in an open condition, until a suitable vehicle capacity is achieved, detected and authenticated.

Further, another embodiment of a second sensor array is shown in FIG. 8 as reference numeral 72B which identifies a camera system 112 which may be implemented with the vehicle 10 to capture image data for use in determining a vehicle occupancy count. In some embodiments, the image data may correspond to a region within the vehicle interior 46 including at least one field of view 114 of one or more imaging devices 116 or cameras. The one or more imaging devices 116 may correspond to a plurality of imaging devices. Each of the imaging devices 116 may have a field of view 114 focusing on an environment within the interior 46 of the vehicle 10, such that all of the seats 102, 104, 106, 108 and 109 within the vehicle 10 are covered by the field of view 114 for determining a real-time vehicle occupancy. Image data collected from the camera system 112 can be sent to the controller 70 for further processing and for verifingy the vehicle occupancy count previously determined using the first sensor array 72.

Figure 6:
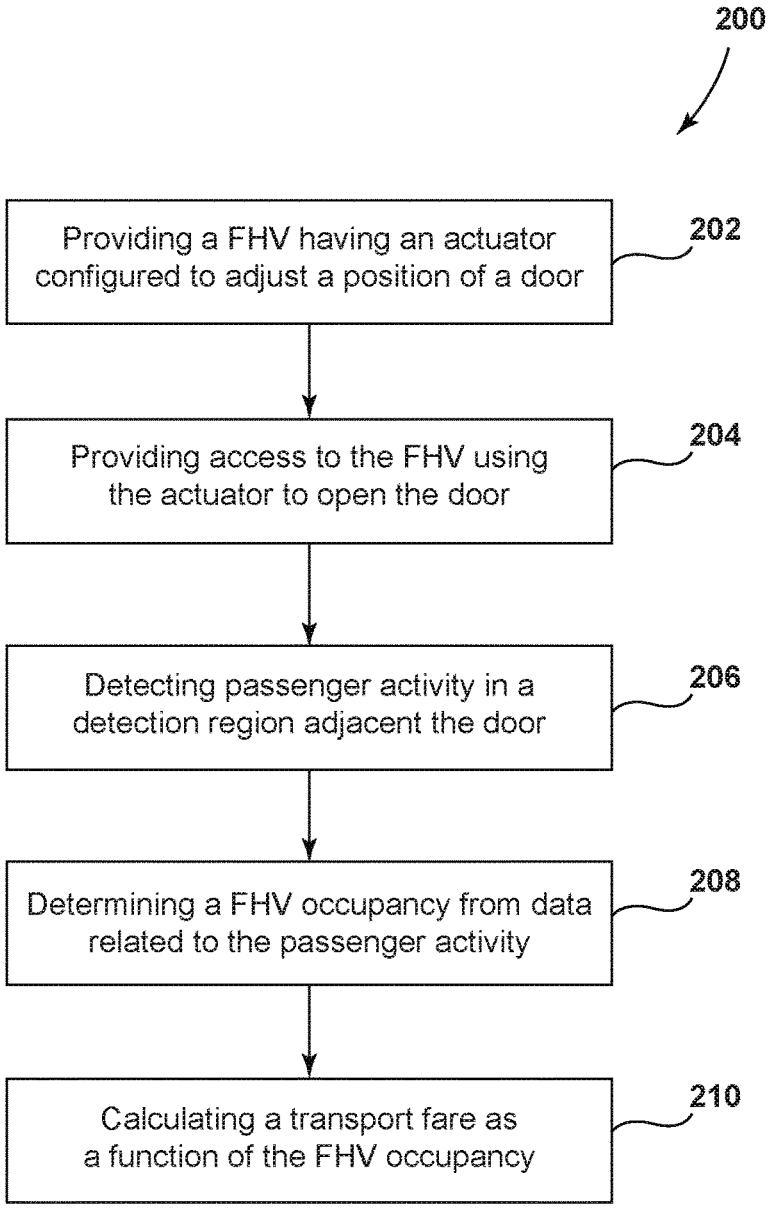
FIG. 6 is a flow chart for a method of calculating transport fare in a for-hire vehicle.

Referring now to FIG. 6, a method of calculating a transport fare in a for-hire vehicle (FHV) is shown as a flow chart. The method 200 includes the step of providing a FHV having an actuator 22 configured to adjust a position of a door 14 in step 202. In step 204, access to the FHV 10 is provided using the actuator 22 to open the door 14. In step 206, passenger activity is detected in a detection region adjacent the door 14. The detection region may include detection regions 36, 38 and 40 shown in FIGS. 1 and 2 and the passenger activity can be detected using the sensor array 72 having sensors 74, 76 and 78. In step 208, a FHV occupancy is determined using data related to the passenger activity detected in step 206. The FHV occupancy can be determined by the controller 70 based on the sensor information sent from the first sensor array 72 to the controller 70. In step 210, a transport fare is calculated as a function of the FHV occupancy. The FHV occupancy is contemplated to be a dynamic or real-time variable used in the calculation of a transport fare. An example of a passenger transport for use with the method 200 shown in FIG. 6 is further described below.

Figure 7:
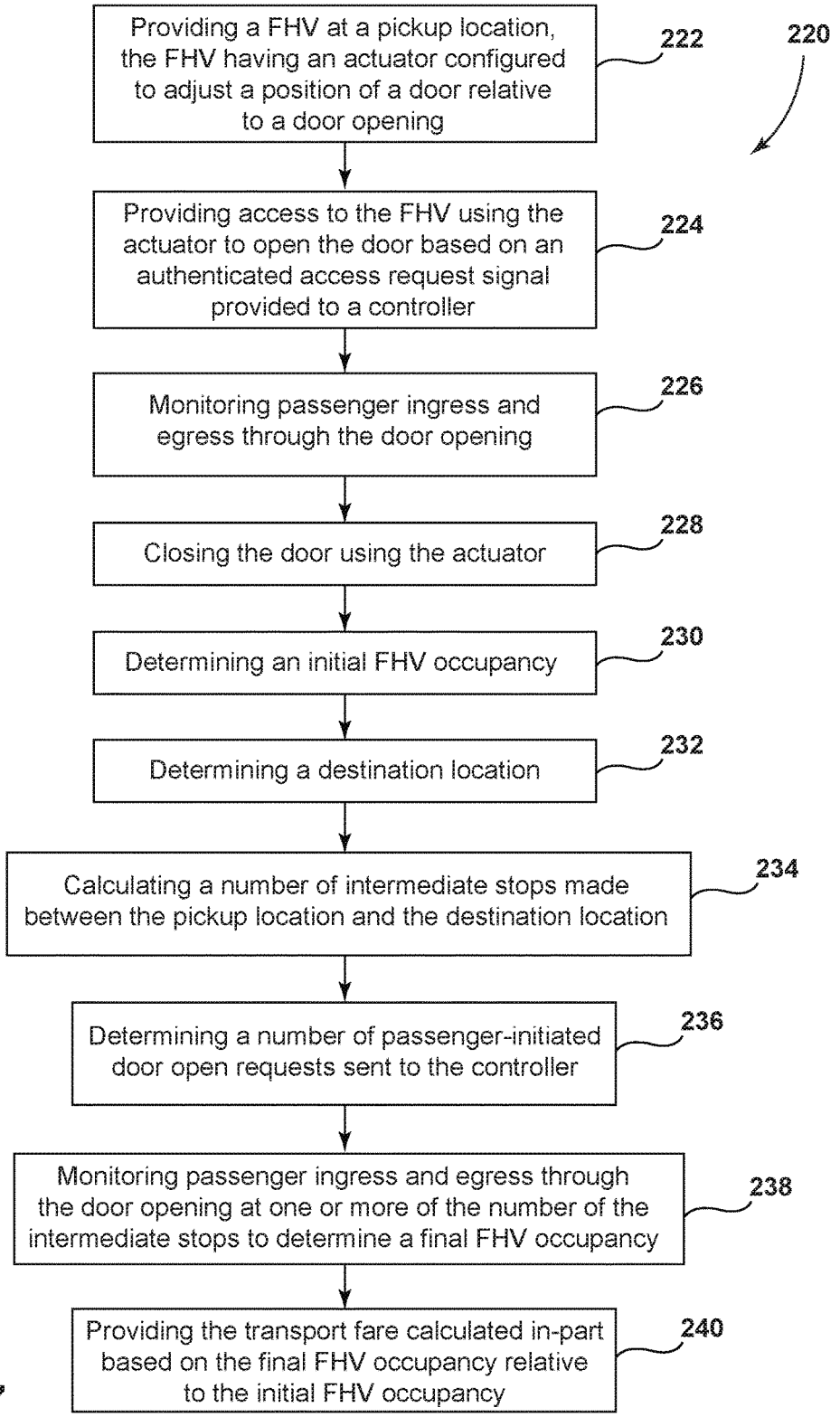
FIG. 7 is a flow chart for a method of a calculating a transport fare in a for-hire vehicle according to another embodiment.

Referring now to FIG. 7, a method of calculating a transport fare in a for-hire vehicle 10 is shown as method 220. The method 220 includes step 222 of providing a FHV 10 at a pick-up location, wherein the FHV 10 includes an actuator 22 configured to adjust a position of a door 14 relative to a door opening 20. In step 224, access to the FHV 10 is provided using the actuator 22 to open the door 14 based on an authenticated access request signal provided to a controller 70. The authenticated access request signal may be provided in a manner as described above with reference to FIGS. 4 and 5. In step 226 of method 220, passenger ingress and egress is monitored at the door opening 20 via sensors, such as sensors 74, 76, and 78 shown in FIG. 2. In step 228, the door 14 is closed using the actuator 22 when a request for a door closure is sent to the controller 70. Steps 222, 224, 226 and 228 are contemplated to take place at the pick-up location as further described below. In step 230, once the door 14 is closed using the actuator 22, an initial FHV occupancy is determined by data collected at the step 226, wherein passenger ingress and egress through the door opening 20 is monitored. It is contemplated that the controller 70 may determine the initial FHV for beginning a passenger transport. In step 232, a transport fare is calculated which further includes the steps of determining a destination location in step 232. In step 234, a number of intermediate stops made between the pick-up location and the destination location is calculated. In step 238, a number of passenger-initiated door open requests are sent to the controller 70. In step 240, passenger ingress and egress is monitored through the door opening 20 at one or more of the intermediary stops to determine a final FHV occupancy for the passenger transport. In step 242, the transport fare is calculated in-part based on the final FHV occupancy relative to the initial FHV occupancy. Other factors used to determine the transport fare may include time and duration of the passenger transport as well as the number of steps in a passenger transport, as further described below.

Figure 9:
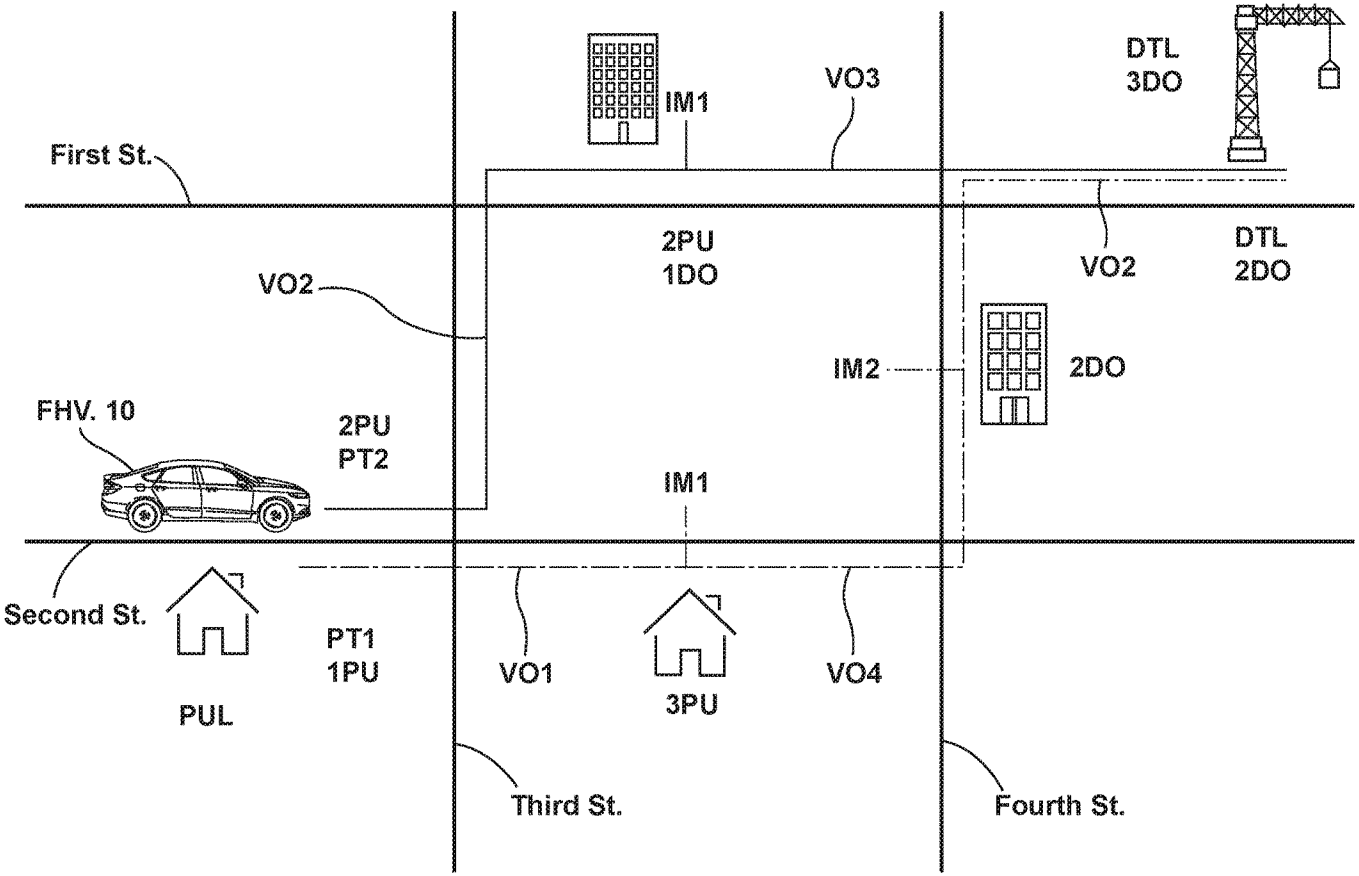
FIG. 9 is a diagrammatic illustration of exemplary passenger transports as mapped from a pickup location to a drop-off destination with one or more intermediary stops indicated therebetween.

Referring to now FIG. 9, an aspect of the present invention is to provide vehicle occupancy information to a controller for calculating a passenger transport fare or rate. The present invention addresses environmental concerns related to one's desire to share a vehicle in transporting passengers to a common destination area, while also addressing the practice of free ride sharing that can occur in public transportation, and particularly with an autonomous FHV. In encouraging a car pool situation, the present invention is contemplated to provide a vehicle occupancy count to provide, for example, a reduced per passenger rate along a portion of a passenger transport. The reduced travel fees will encourage passengers to share a passenger transport in an FHV when they are able to do so. Similarly, the practice of free ride sharing is readily detectable by the system of the present invention, as passengers entering, exiting and riding within the FHV is detectable using one or more of the sensor arrays described above along with an automated door opening and closing system.

With specific reference to FIG. 9, a FHV 10 is shown as a vehicle configured to transport passengers for a transport fare calculated using the system of the present invention, wherein the vehicle occupancy is a variable in the transport fare calculation. The vehicle occupancy is a numeric value that is automatically set at the beginning of a passenger transport and dynamically updated throughout the course of the passenger transport in real-time. The transport fare is calculated as a function of the real-time vehicle occupancy. As shown in FIG. 9, a first passenger transport PT1 begins at a pickup location PUL with one pickup passenger 1PU. A second passenger transport PT2 is shown in FIG. 9 and is discussed further below. The first passenger transport PT1 proceeds down Second Street with a vehicle occupancy of one passenger (VO1) for a first leg of the passenger transport PT1 until the FHV 10 gets to a first intermediate stop IM1. At the first intermediate stop IM1, three passengers 3PU are picked up, such that the vehicle occupancy VO changes for a second leg of the passenger transport PT1 from vehicle occupancy VO1 to vehicle occupancy VO4. A second intermediate stop IM2 is noted in the second leg of the first passenger transport PT1 along Fourth Street. At this second intermediate stop IM2, two passengers are dropped off (2DO). Thus, a third leg of the first passenger transport PT1 includes a vehicle occupancy of two (VO2) to a destination location DTL. At destination location DTL, the two remaining passengers (2DO) are dropped off as indicated in FIG. 9. Thus, the first passenger transport PT1 includes three legs in which the vehicle occupancy begins with initial vehicle occupancy of one (VO1), updates to a vehicle occupancy of four (VO4) at the first intermediary stop IM1, and concludes with a final vehicle occupancy of two (VO2) at destination location DTL due to the two passengers exiting the FHV 10 at second intermediate stop IM2.

Thus, for PT1, a transport rate is calculated for the first leg of the trip between the pickup location PUL and the first intermediary stop IM1 with a vehicle occupancy of one (VO1). The second leg has a transport fare calculated between the first and second intermediary stops IM1, IM2 with a vehicle occupancy of four (VO4). The third leg has a transport fare calculated between the second intermediate stop IM2 and the destination location DTL with a vehicle occupancy of two (VO2). A controller, such as controller 70 shown in FIG. 2, is used to calculate the transport fare as a function of the dynamic or real-time vehicle occupancy. Other factors such as the travel time and distance for the three different legs of the first passenger transport PT1 are also factored into the fare calculation. It is contemplated that the transport fare would include a per passenger rate that is greatest at the first leg of the passenger transport PT1 with a vehicle occupancy of one (VO1), and is least at the second leg of the passenger transport PT1 having a vehicle occupancy of four (VO4). The third leg of the first passenger transport PT1 would generally include a per passenger rate that is somewhere in between the first and second legs of passenger transport PT1. It is contemplated that the controller 70 can be configured to apply a rate reduction factor that increases with the number of vehicle occupants, or is a constant that is figured into the transport rate calculation in a consistent manner with the varying vehicle occupancy over the total passenger transport.

With further reference to FIG. 9, a second passenger transport PT2 is shown beginning at pickup location PUL with initial vehicle occupancy of two (VO2). The vehicle occupancy remains at two until a first intermediary stop IM1 located on First Street in FIG. 9. At intermediary stop IM1, two passengers (2PU) are picked up and one passenger (1DO) is dropped off. As such, a second leg of the trip from the first intermediary stop IM1 to the destination location DTL includes a vehicle occupancy of three (VO3). Thus, the second passenger transport PT2 includes first and second legs with vehicle occupancies of two and three, respectively. A standard autonomous vehicle would likely not be made aware of the passenger exchange taking place at the first intermediary stop IM1 in the passenger transport PT2. This could encourage free ride sharing scenarios between passengers. The system of the present invention provides for dynamic or real-time vehicle occupancy data to be sent to a controller using the automatic door opening and closing system described above, along with the sensor data of the one or more sensor arrays also described above. Thus, with specific reference to the second passenger transport PT2, the FHV 10 arrives at pickup location PUL wherein the two passengers may be authenticated as the passengers requesting the FHV for passenger transport. Once authenticated, the FHV 10 can open one or more of the doors using an actuator in a manner as described above. A first sensor array, such as sensor array 72 noted above, can be used to provide passenger activity data to the controller around the door opening which the controller 70 will use to determine an initial vehicle occupancy. That initial vehicle occupancy can be authenticated by a second sensor array, such as weight sensors in the seats or a camera system. At intermediary stop IM1, a request for a door opening can be sent to the controller, wherein the controller will open the door using the actuator. Passenger activity is again monitored by one or more sensor arrays and a new vehicle occupancy is determined by the controller using data from the monitoring and detection systems. In this way, at all possible points along a passenger transport, the present invention can determine a vehicle occupancy count for calculating dynamic transport rates for various legs of a particular passenger transport.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door system, comprising:

a for-hire vehicle (FHV) having a door;

an actuator configured to adjust a position of the door;

an apparatus configured to detect vehicle occupancy data, wherein the apparatus comprises at least one sensor disposed about the door of the vehicle, the at least one sensor comprising a first detection region positioned at a first distance from a hinge assembly of the door and a second detection region positioned at a second distance from the hinge assembly; and a controller configured to:

control the actuator to position the door in an open position providing access to a passenger compartment;

detect a vehicle occupancy based on an ingress or egress of a passenger, wherein the detection of the ingress and egress comprises identifying movement of the passenger from the first detection region to the second detection region;

process the vehicle occupancy data to determine a real-time vehicle occupancy over a course of a passenger transport; and calculate a transport fare as a function of the real-time vehicle occupancy.

2. The vehicle door system of claim 1, wherein the at least one sensor is configured to monitor the passenger ingress and egress from the door when the door is in the open position.

3. The vehicle door system of claim 2, wherein the at least one sensor defines a first sensor array having a plurality of sensors disposed about the door.

4. The vehicle door system of claim 3, wherein each sensor of the plurality of sensors includes one of a capacitive sensor and an inductive sensor.

5. The vehicle door system of claim 4, including:

a second sensor array, wherein each sensor of the second sensor array is associated with a seat of a plurality of seats disposed within the FHV.

6. The vehicle door system of claim 5, wherein each sensor of the second sensor array corresponds to a weight sensor for determining an occupancy condition of each seat associated with each sensor.

7. The vehicle door system of claim 1, wherein the apparatus corresponds to an interference sensor configured to detect a vehicle passenger in a plurality of detection regions including the first detection region and the second detection region along a radial extent of the door.

8. The vehicle door system of claim 7, wherein the interference sensor is configured to detect a direction of movement of the vehicle passenger along the detection regions towards or away from an interior of the FHV.

9. The vehicle door system of claim 8, wherein the controller is further configured to determine if the vehicle passenger is entering or exiting the FHV interior based on the direction of movement detected by the interference sensor.

10. A method of calculating a transport fare in a for-hire vehicle (FHV), comprising:

communicating with a mobile device identifying an occupancy request of the FHV from a patron;

providing the FHV having an actuator configured to adjust a position of a door;

identifying the patron proximate the FHV by communicating with the mobile device;

positioning the door in an open configuration with a door actuator in response to the identification of the patron;

detecting passenger activity in a detection region between the door and a passenger compartment with a detection sensor, wherein detecting the passenger activity comprises detecting an ingress or egress of a passenger moving from a first detection region to a second detection region along a radial extent of the door;

determining a FHV occupancy from data related to the passenger activity; and calculating said transport fare as a function of the FHV occupancy.

11. The method of claim 10, wherein the FHV occupancy is a real-time FHV occupancy determined over a course of a passenger transport.

12. The method of claim 11, wherein the course of the passenger transport includes a pickup location, at which access is provided to the FHV.

13. The method of claim 12, wherein the course of the passenger transport further includes one or more intermediary drop-off locations, at which passenger activity is detected for determining the FHV occupancy when the actuator is used to open the door at the one or more intermediary drop-off locations.

14. The method of claim 13, wherein the step of calculating the transport fare includes providing time and distance data relative to the course of the passenger transport to a controller associated with the FHV.

15. The method of claim 10, wherein the step of detecting passenger activity in the detection region adjacent the door further includes:

sensing the passenger ingress and egress from the door when the door is in an open position using a plurality of sensors.

16. The method of claim 15, wherein the plurality of sensors includes sensors having serially aligned detection regions to determine whether a passenger is entering or exiting the FHV.

17. A method of calculating a transport fare in a for-hire vehicle (FHV), comprising:

receiving a request from a mobile device by the FHV identifying a pickup location;

communicating with the mobile device identifying an occupancy request of the FHV from a patron;

providing the FHV at the pickup location, the FHV having an actuator configured to adjust a position of a door relative to a door opening;

identifying a passenger proximate the vehicle by communicating with the mobile device;

providing access to the FHV using the actuator to open the door based on an authenticated access request signal provided to a controller in response to the identification of the patron proximate the vehicle;

monitoring an ingress and egress of the patron through the door opening, wherein monitoring the ingress or egress of the patron comprises detecting the patron moving from a first detection region to a second detection region along a radial extent of the door;

closing the door using the actuator;

determining an initial FHV occupancy; and calculating said transport fare, further including;

determining a destination location;

calculating a number of intermediate stops made between the pickup location and the destination location;

determining a number of passenger-initiated door open requests sent to the controller;

monitoring passenger ingress and egress through the door opening at one or more of the number of the intermediate stops to determine a final FHV occupancy; and providing the transport fare calculated in-part based on the final FHV occupancy relative to the initial FHV occupancy.

18. The vehicle door system of claim 1, wherein the ingress or egress of the passenger is detected in response to detecting a first signal of the first detection region exceeding a first detection threshold and a second signal of the second detection region exceeding a second detection threshold.

19. The vehicle door system of claim 18, wherein the ingress of the passenger is further detected in response to a sequential detection of the first signal exceeding the first detection threshold and the second signal exceeding the second detection threshold.

* * * * *